US005326610A

United States Patent [19]

Moss

[11] Patent Number: 5,326,610

[45] Date of Patent: Jul. 5, 1994

[54] WASHCLOTH INCLUDING A POCKET FOR RETAINING AN OBJECT

[76] Inventor: Thomas Moss, 10101 Forum, #2021, Farmpark, Houston, Tex. 77036

[21] Appl. No.: 998,629

[22] Filed: Dec. 30, 1992

[51] Int. Cl.[5] ..... A47K 7/03; B32B 3/14

[52] U.S. Cl. ..... 428/78; 428/102; 15/208; 401/201

[58] Field of Search ..... 428/78, 100, 102; 15/227, 244.3, 208; 252/93; 401/201

[56] References Cited

U.S. PATENT DOCUMENTS

| | | | |
|---|---|---|---|
| 1,681,031 | 8/1928 | Forbis | 15/208 |
| 2,006,708 | 7/1935 | Benedict | 15/208 |
| 2,119,895 | 6/1938 | Sutton | 15/208 |
| 2,669,737 | 2/1954 | Evans | 401/201 |
| 2,817,865 | 12/1957 | Arioli | 15/208 |
| 4,154,542 | 5/1979 | Rasmason | 15/227 |
| 4,736,853 | 4/1988 | O'Mara | 428/100 |

*Primary Examiner*—Alexander S. Thomas

[57] ABSTRACT

A washcloth including a pocket for holding an object includes a first piece of fabric having a predetermined length and width. A second piece of fabric having a predetermined length and width is provided wherein the predetermined length and width of the second piece of fabric is smaller in size relative to the first piece of fabric. The second piece of fabric is positioned relative to the first piece of fabric for defining a pocket therebetween with an opening in communication with the pocket being provided for enabling an object to be inserted within the pocket. A third piece of fabric, having a predetermined length and width is provided and is secured relative to the first piece of fabric for providing a closure for the opening provided in communication with the pocket for retaining an object positioned within the pocket.

5 Claims, 1 Drawing Sheet

WASHCLOTH INCLUDING A POCKET FOR RETAINING AN OBJECT

BACKGROUND OF THE INVENTION

1. Field of the Invention

The present invention is directed to a washcloth which includes a piece of fabric affixed relative to another piece of fabric for providing a pocket therebetween for retaining an object. A flap is provided for retaining the object within the pocket.

2. Description of Background Art

Hithertofore, washcloths have been available which conventional consist of a single sheet of fabric designed to be used together with a bar of soap in order to enable an individual to apply soap to the fabric for later application of the soap to the individual's body. Unfortunately, a number of individuals are disabled and are not able to utilize a bar of soap together with a washcloth in order to permit the washing of the individual's body.

Washcloths have been designed which include merely a pocket for inserting a bar of soap therebetween. However, the pocket does not provide a means for retaining the soap within the pocket so as to prevent the soap from being dislodged during normal use.

SUMMARY AND OBJECTS OF THE INVENTION

It is an object of the present invention to provide a pocket which is affixed to a washcloth for retaining an object therein. A flap is provided adjacent to the pocket so as to retain the object positioned within the pocket.

Another object of the present invention is to provide a washcloth which permits a disabled individual or an individual with arthritic conditions to easily use the soap contained with the pocket affixed to the washcloth during normal washing.

Another object of the present invention is to provide a washcloth which includes a pocket wherein ice or other cold material may be inserted so as to provide relief during an injury.

These and other objects of the present invention are achieved by providing a washcloth including a pocket for holding an object therein. A first piece of fabric has a predetermined length and width. A second piece of fabric is provided with a predetermined length and width. The predetermined length and width of the second piece of fabric is smaller in size relative to the first piece of fabric. The second piece of fabric is secured relative to the first piece of fabric for defining a pocket therein. An opening is provided in communication with the pocket for enabling an object to be inserted within the pocket. A third piece of fabric is provided which is secured relative to the first piece of fabric for providing a closure for the opening provided in communication with the pocket for retaining an object positioned within the pocket.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENT

Figure 1:
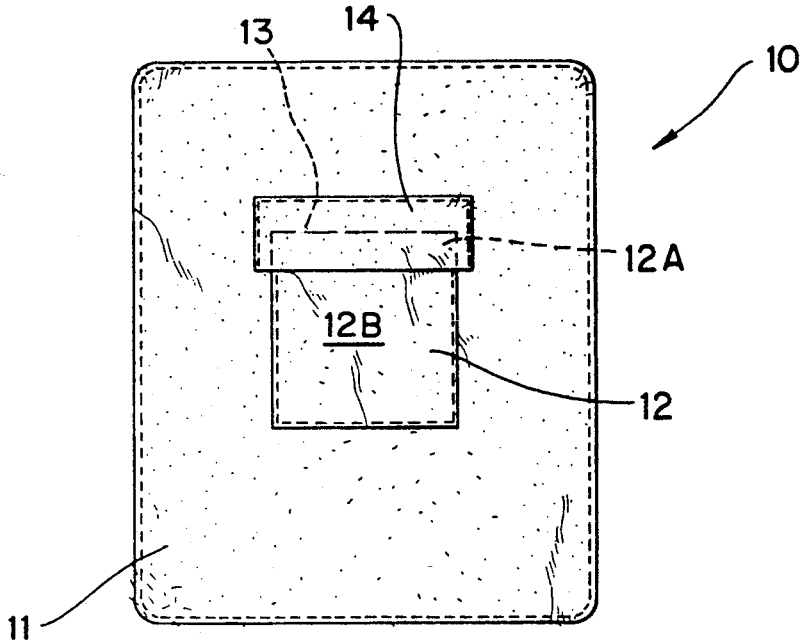
FIG. 1 is a top plan view of a washcloth including a second piece of fabric secured thereto and a flap for closing the opening to the pocket provided therein.
Figure 2:
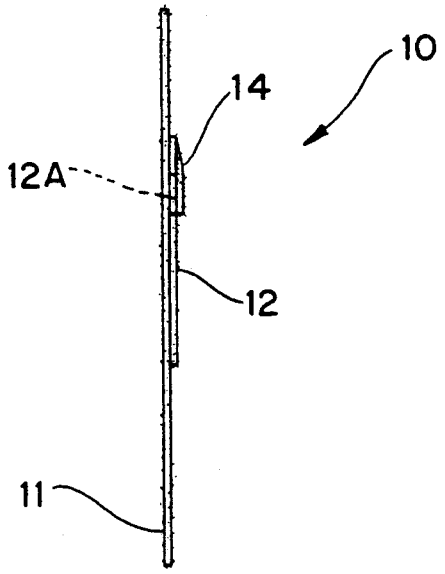
FIG. 2 is a side elevational view of the washcloth illustrated in FIG. 1.

FIGS. 1 and 2 illustrate a washcloth 10 with a pocket 12B. A conventional washcloth forms a first piece of fabric 11. A second piece of fabric 12 is secured relative to the first piece of fabric 11 to form the pocket 12B therebetween.

An opening 13 is provided to permit access to the pocket 12B. An object may be inserted through the opening 13 into the pocket 12B. A third piece of fabric 14 is provided as a flap to provide a closure to the opening 13. A portion 12A of the second piece of fabric 12 is positioned beneath the third piece of fabric 14. In this way, the third piece of fabric 14 provides a closure for retaining an object positioned within the pocket 12B.

In use, an individual would open the flap 14 to gain access to the opening 13 which is in communication with the pocket 12B. Thereafter, an individual can insert a conventional bar of soap, soap powder, soap liquid or any other material designed to be used to assist an individual during bathing. After the pocket 12B has a sufficient supply of soap positioned therein, the flap 14 is returned to its normal position wherein the flap 14 covers the opening 13 to thereby retain the material within the pocket 12B.

The second piece of fabric 12 is secured along three edges to the first piece of fabric 11. The flap 14 is secured along at least an upper edge 14A to the first piece of fabric 11. In this way, the flap 14 is affixed directly adjacent to the opening 13 to permit access to be gained to the pocket 12B while also permitting the flap 14 to function as a closure to retain an object positioned within the pocket 12B.

In another embodiment, the flap 14 may be secured relative to the first piece of fabric 11 along three edges thereof. In this way, when an individual wishes to gain access to the opening 13, the individual would actually fold the cloth back upon itself to permit the third piece of fabric 14 to open, thereby enabling an individual to supply material through the opening 13 into the pocket 12B.

In another embodiment of the present invention, an individual may insert ice or other cold material into the pocket 12B to assist as a source of cold for aiding an individual during an injury. The washcloth including the pocket 12B may be utilized in this way to reduce the pain an individual is suffering relative to a small bruise.

The present invention is extremely helpful to assist an individual who is handicapped, effected by chronic nervousness or serious arthritic conditions. Being able to position a bar of soap or other soap product within a pocket in a washcloth is extremely helpful to many handicapped individuals who are not able to utilize a bar of soap which is a separate item independent of the washcloth.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A washcloth including a pocket for holding an object comprising:

a first piece of fabric having a predetermined length and width;

a second piece of fabric, said second piece of fabric having a predetermined length and width, the predetermined length and width of said second piece of fabric being smaller in size relative to said first piece of fabric, said second piece of fabric being secured relative to said first piece of fabric for defining a pocket therebetween with an opening in communication with said pocket being provided for enabling an object to be inserted within said pocket; and a third piece of fabric positioned adjacent to said opening to form a closure, said third piece of fabric having a predetermined length and width and being secured to said first piece of fabric to provide said closure for the opening provided in communication with said pocket for retaining an object positioned within said pocket, said predetermined length of said third piece of fabric being greater than and overlapping the predetermined length of said second piece of fabric while permitting manipulation of said third piece of fabric for enabling an object to be passed beneath said third piece of fabric and into said pocket.

2. The washcloth according to claim 1, wherein said second piece of fabric is sewn to said first piece of fabric along three sides thereof with a fourth side forming said opening in communication with said pocket.

3. The washcloth according to claim 1, wherein said first, second and third fabrics are made of terry cloth.

4. The washcloth according to claim 1, wherein said third piece of fabric is sewn to said first piece of fabric along at least one length dimension thereof and along two width dimensions thereof.

5. The washcloth according to claim 1, wherein said second piece of fabric is approximately the size of a conventional bar of soap and said first piece of fabric is approximately the size of a conventional washcloth, said second piece of fabric being centered relative to said first piece of fabric.

* * * * *